US007140276B1

(12) United States Patent
Jeng

(10) Patent No.: US 7,140,276 B1
(45) Date of Patent: Nov. 28, 2006

(54) ADJUSTABLE WRENCH

(76) Inventor: Gwo Jong Jeng, No. 22, Lane 427, Dasheng Street, Taichung City 408 (TW)

( * ) Notice: Subject to any disclaimer, the term of this patent is extended or adjusted under 35 U.S.C. 154(b) by 145 days.

(21) Appl. No.: 10/948,830

(22) Filed: Sep. 24, 2004

(51) Int. Cl.
*B25B 13/12* (2006.01)
*B25B 13/18* (2006.01)
*B25B 13/16* (2006.01)

(52) U.S. Cl. ..... 81/150; 81/154; 81/128; 81/165; 81/173

(58) Field of Classification Search ..... 81/150–154, 81/128, 165, 138, 143, 148, 149, 173
See application file for complete search history.

(56) References Cited

U.S. PATENT DOCUMENTS 122,787 A * 1/1872 Taft ..... 81/128
620,485 A * 2/1899 McCune ..... 81/165
1,074,394 A * 9/1913 Waldron ..... 81/128
1,397,214 A * 11/1921 Hose ..... 81/151
1,501,214 A * 7/1924 Garrison ..... 81/151
1,501,329 A * 7/1924 Greve ..... 81/128
1,915,396 A * 6/1933 Alemany ..... 81/128
3,363,490 A * 1/1968 Maichen ..... 81/128
4,903,556 A * 2/1990 Spirov et al. ..... 81/154
6,983,676 B1 * 1/2006 Huang ..... 81/145

* cited by examiner

*Primary Examiner*—Hadi Shakeri

(57) ABSTRACT

An adjustable wrench includes a fixed body having a first end formed with a fixed jaw, a mediate portion formed with a mounting portion and a second end formed with a receiving recess, and a movable body movably mounted on the fixed body and having a first end formed with a movable jaw facing the fixed jaw and a second end formed with a mounting edge slidably mounted on the mounting portion. Thus, the fixed body has a substantially H-shaped mounting portion, and the movable body has a substantially C-shaped mounting edge slidably mounted on the mounting portion of the fixed body, so that the movable body is mounted on the fixed body rigidly and stably.

1 Claim, 17 Drawing Sheets

ADJUSTABLE WRENCH

BACKGROUND OF THE INVENTION

1. Field of the Invention

The present invention relates to an adjustable wrench, and more particularly to an adjustable wrench that is made easily and conveniently.

2. Description of the Related Art

A conventional adjustable wrench in accordance with the prior art shown in FIGS. 15–17 comprises a fixed body 60 having a first end formed with a fixed jaw 62 and a second end formed with an elongated channel 61, and a movable body 70 movably mounted on the fixed body 60 and having an a first end formed with a movable jaw 72 facing the fixed jaw 62 of the fixed body 60 and a second end formed with a protruding slide 71 slidably mounted in the elongated channel 61 of the fixed body 60. However, the elongated channel 61 of the fixed body 60 has a first portion having a substantially U-shaped cross-section as shown in FIG. 16 and a second portion having a substantially O-shaped cross-section as shown in FIG. 17, so that the elongated channel 61 of the fixed body 60 is not easily made by a molding process, thereby increasing costs of fabrication.

SUMMARY OF THE INVENTION

The primary objective of the present invention is to provide an adjustable wrench that is made easily and conveniently.

Another objective of the present invention is to provide an adjustable wrench, wherein the fixed body has a substantially H-shaped mounting portion, and the movable body has a substantially C-shaped mounting edge slidably mounted on the mounting portion of the fixed body, so that the movable body is mounted on the fixed body rigidly and stably.

A further objective of the present invention is to provide an adjustable wrench, wherein the fixed body has a substantially H-shaped mounting portion, so that the fixed body is easily made by a molding process, thereby decreasing costs of fabrication.

A further objective of the present invention is to provide an adjustable wrench, wherein the movable body has a substantially C-shaped mounting edge, so that the movable body is easily made by a molding process, thereby decreasing costs of fabrication.

In accordance with the present invention, there is provided an adjustable wrench, comprising:

a fixed body having a first end formed with a fixed jaw, a mediate portion formed with a substantially H-shaped mounting portion and a second end formed with a receiving recess communicating with the mounting portion; and a movable body movably mounted on the fixed body and having a first end formed with a movable jaw facing the fixed jaw of the fixed body and a second end formed with a substantially C-shaped mounting edge slidably mounted on the mounting portion of the fixed body.

Further benefits and advantages of the present invention will become apparent after a careful reading of the detailed description with appropriate reference to the accompanying drawings.

DETAILED DESCRIPTION OF THE INVENTION

Figure 1:
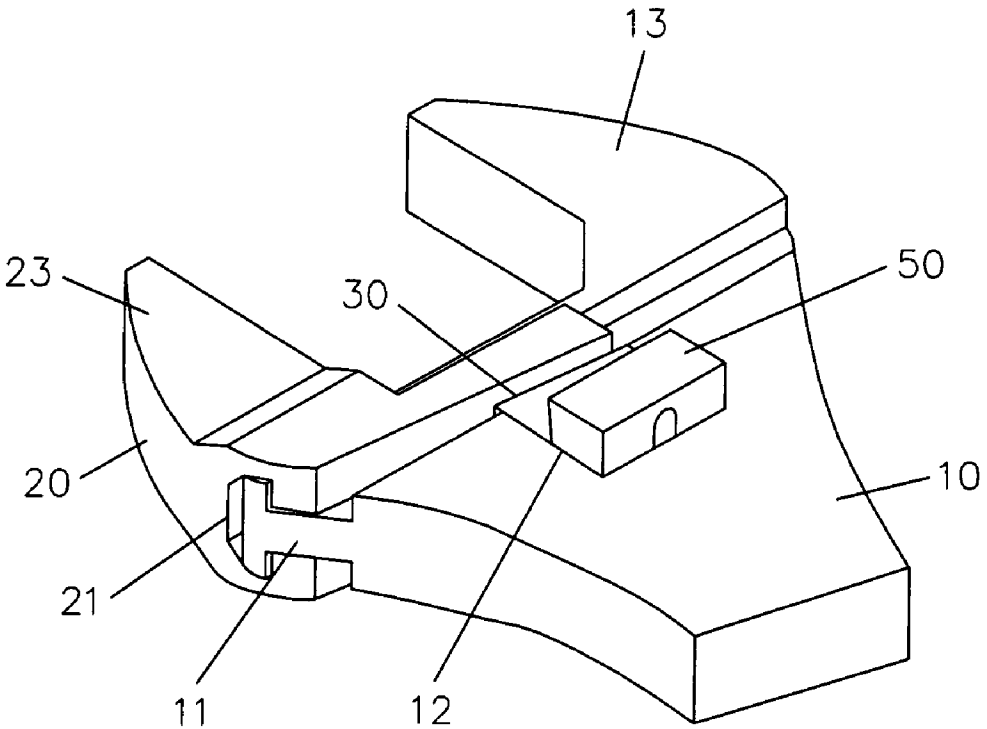
FIG. 1 is a perspective view of an adjustable wrench in accordance with the preferred embodiment of the present invention.
Figure 2:
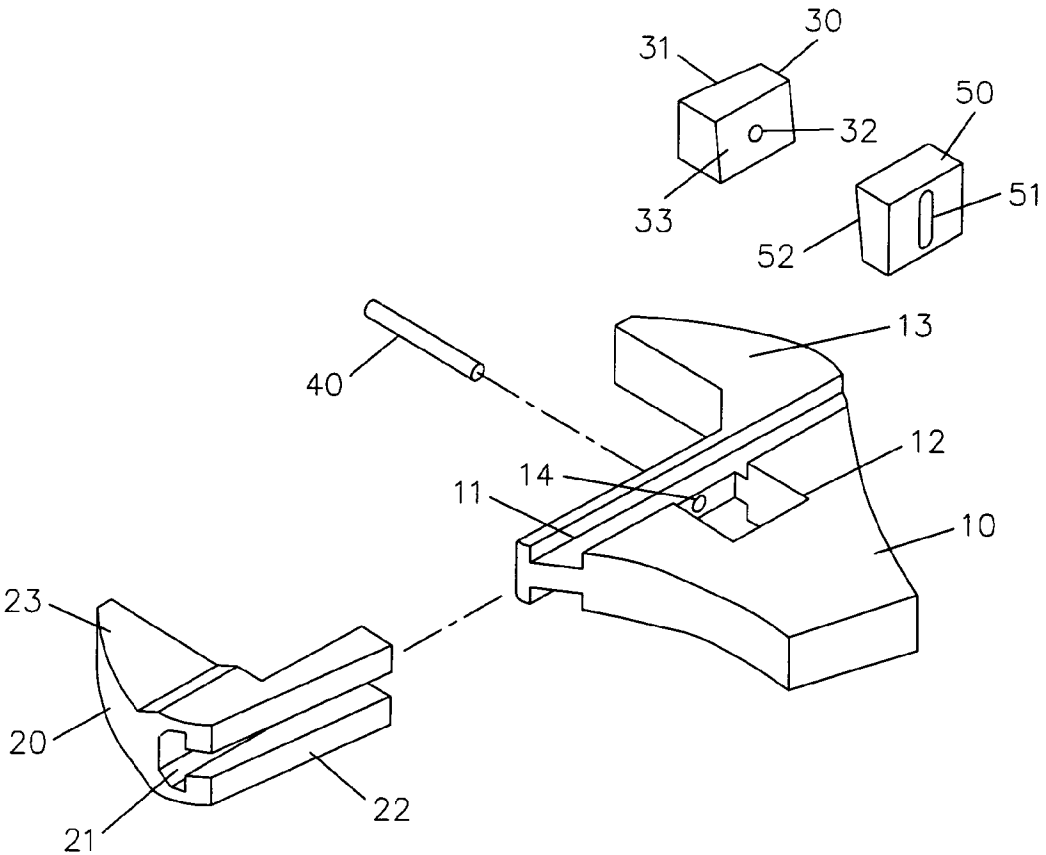
FIG. 2 is an exploded perspective view of the adjustable wrench as shown in FIG. 1.

Referring to the drawings and initially to FIGS. 1–6, an adjustable wrench in accordance with the preferred embodiment of the present invention comprises a fixed body 10 having a first end formed with a fixed jaw 13, a mediate portion formed with a substantially H-shaped mounting portion 11 and a second end formed with a receiving recess 12 communicating with the mounting portion 11, and a movable body 20 movably mounted on the fixed body 10 and having a first end formed with a movable jaw 23 facing the fixed jaw 13 of the fixed body 10 and a second end formed with a substantially C-shaped mounting edge 21 slidably mounted on the mounting portion 11 of the fixed body 10.

The receiving recess 12 of the fixed body 10 has a wall formed with a fixing hole 14. The mounting edge 21 of the movable body 20 has a side formed with an inclined face 22.

A fixing block 30 is movably mounted in the receiving recess 12 of the fixed body 10 and has a first side formed with a first inclined face 31 rested on the inclined face 22 of the mounting edge 21 of the movable body 20 and a second side formed with a second inclined face 33. The fixing block 30 is formed with a circular hole 32.

An urging block 50 is movably mounted in the receiving recess 12 of the fixed body 10 and has a first side formed with an oblique press face 52 rested on the second inclined face 33 of the fixing block 30 and a second side rested on an end face of the receiving recess 12 of the fixed body 10. The urging block 50 is formed with an elongated slot 51.

A fixing rod 40 is extended through the fixing hole 14 of the fixed body 10, the circular hole 32 of the fixing block 30 and the elongated slot 51 of the urging block 50 to limit the fixing block 30 and the urging block 50 in the receiving recess 12 of the fixed body 10.

Figure 3:
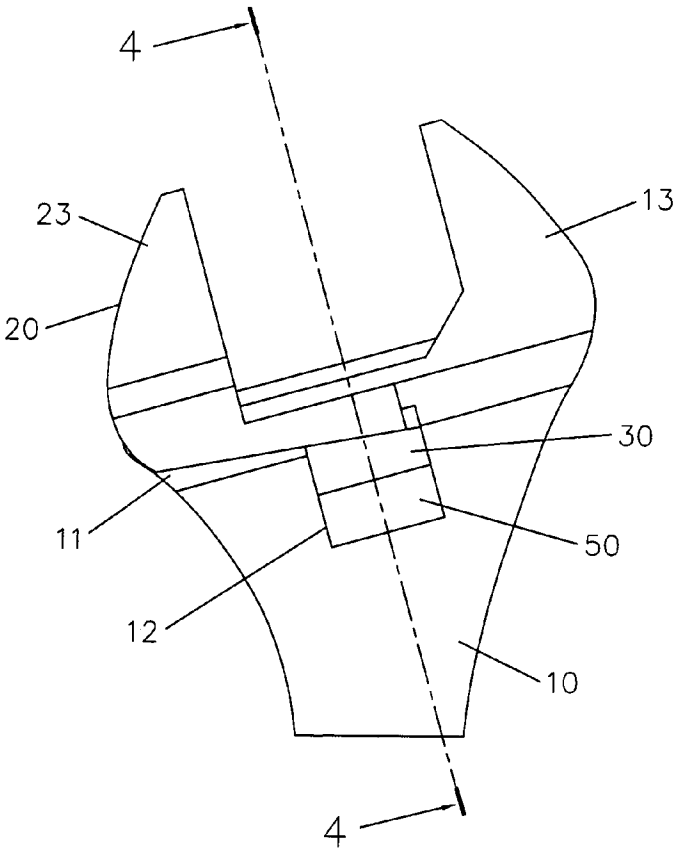
FIG. 3 is a top plan view of the adjustable wrench as shown in FIG. 1.
Figure 4:
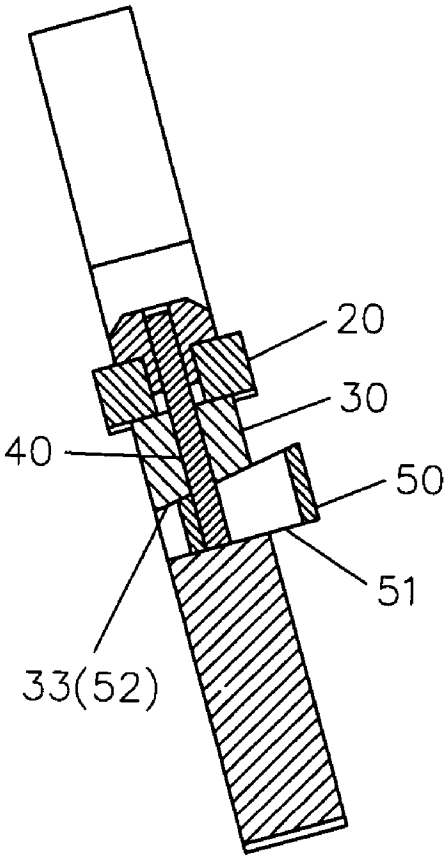
FIG. 4 is a plan cross-sectional view of the adjustable wrench taken along line 4—4 as shown in FIG. 3.

As shown in FIGS. 3 and 4, the fixing block 30 and the urging block 50 are limited in the receiving recess 12 of the fixed body 10 by the fixing rod 40. In addition, the oblique press face 52 of the urging block 50 is rested on the second inclined face 33 of the fixing block 30, and the first inclined face 31 of the fixing block 30 is rested on the inclined face 22 of the mounting edge 21 of the movable body 20, so that the movable body 20 is fixed on the fixed body 10.

Figure 5:
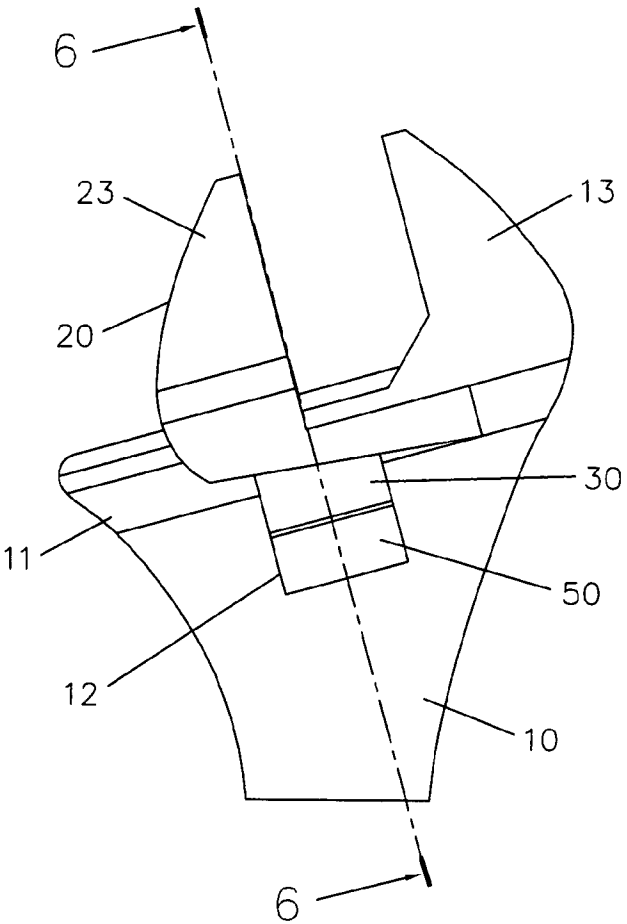
FIG. 5 is a schematic operational view of the adjustable wrench as shown in FIG. 3.
Figure 6:
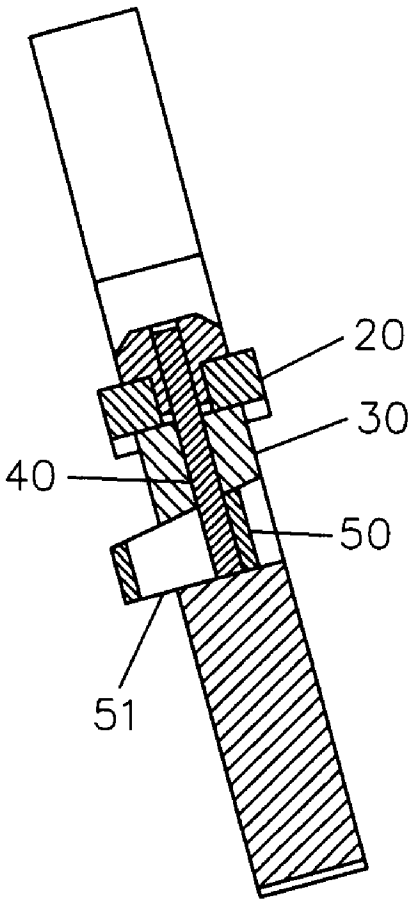
FIG. 6 is a schematic operational view of the adjustable wrench as shown in FIG. 4.
Figure 7:
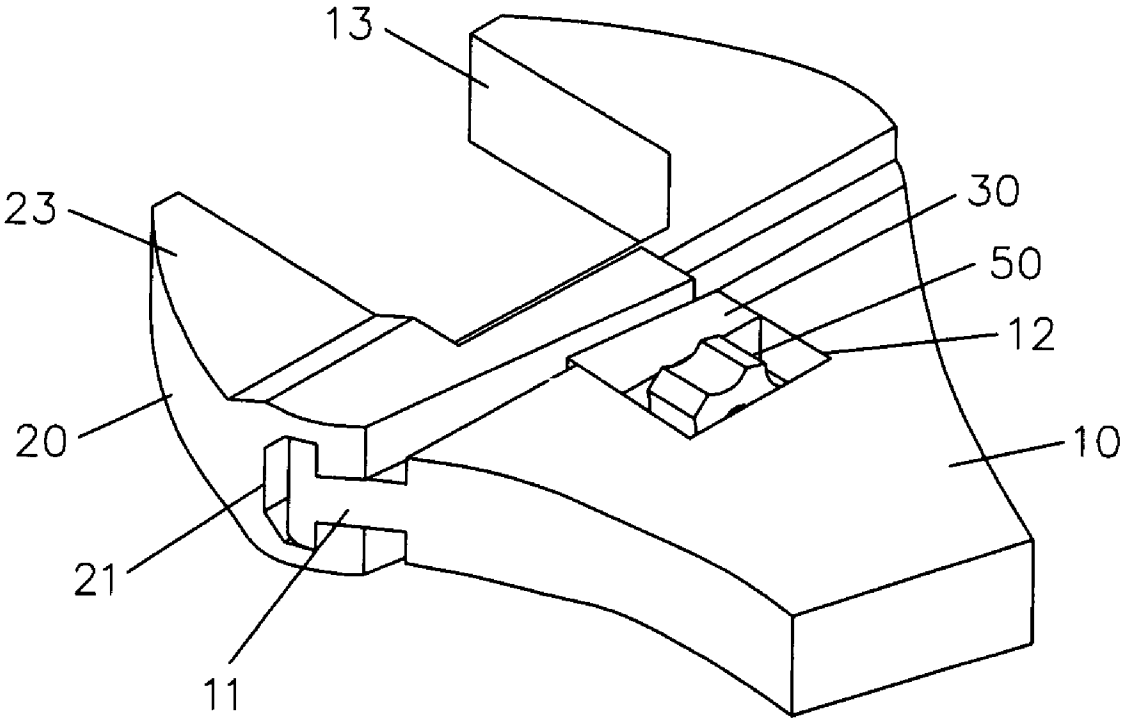
FIG. 7 is a perspective view of an adjustable wrench in accordance with another embodiment of the present invention.
Figure 8:
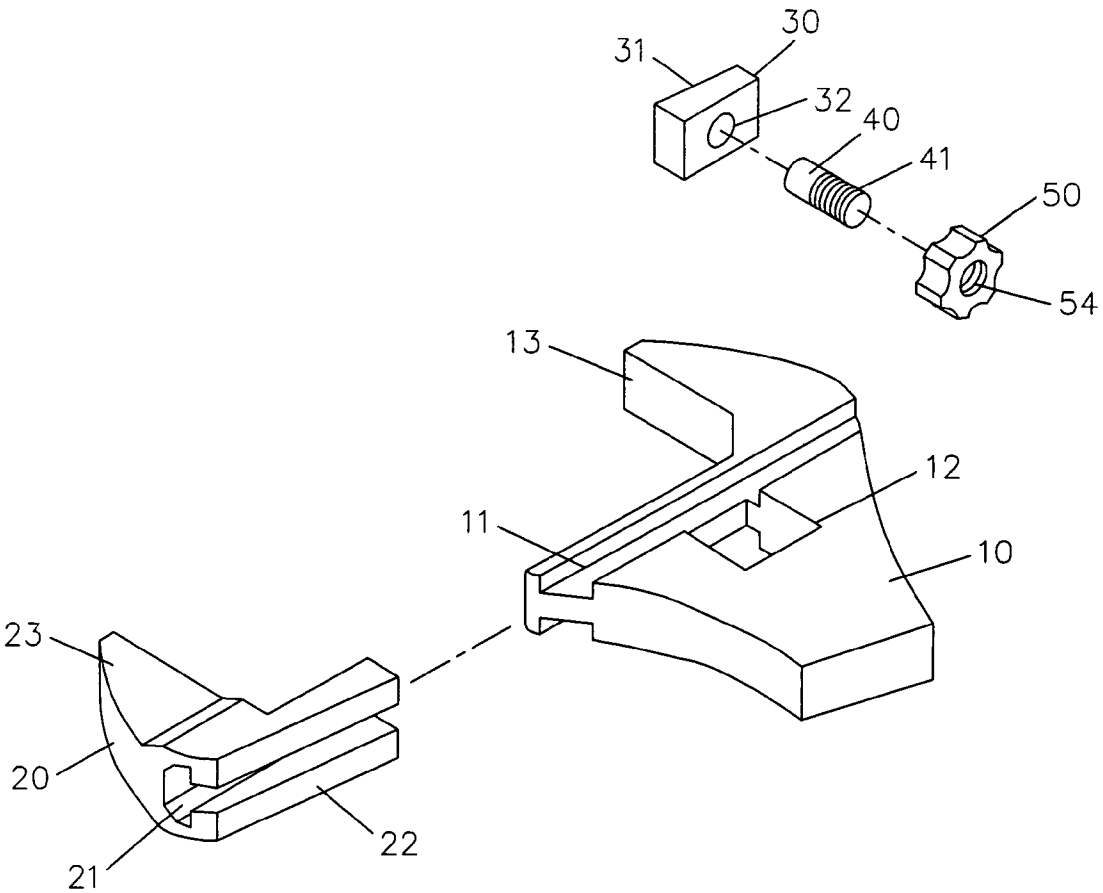
FIG. 8 is an exploded perspective view of the adjustable wrench as shown in FIG. 7.

As shown in FIGS. 5 and 6, the movable body 20 is pushed rightward to detach the inclined face 22 of the mounting edge 21 of the movable body 20 from the first inclined face 31 of the fixing block 30. Then, the urging block 50 is pressed downward so that the oblique press face 52 of the urging block 50 presses the second inclined face 33 of the fixing block 30 to push the fixing block 30 to move forward until the first inclined face 31 of the fixing block 30 is again rested on the inclined face 22 of the mounting edge 21 of the movable body 20, so that the movable body 20 is fixed on the fixed body 10.

Accordingly, the fixed body 10 has a substantially H-shaped mounting portion 11, and the movable body 20 has a substantially C-shaped mounting edge 21 slidably mounted on the mounting portion 11 of the fixed body 10, so that the movable body 20 is mounted on the fixed body 10 rigidly and stably. In addition, the fixed body 10 has a substantially H-shaped mounting portion 11, so that the fixed body 10 is easily made by a molding process, thereby decreasing costs of fabrication. Further, the movable body 20 has a substantially C-shaped mounting edge 21, so that the movable body 20 is easily made by a molding process, thereby decreasing costs of fabrication.

Referring to FIGS. 7–10, the fixing rod 40 is fixed in the receiving recess 12 of the fixed body 10 and has a first end inserted into the circular hole 32 of the fixing block 30 and a second end formed with a threaded portion 41, and the urging block 50 is rotatably mounted in the receiving recess 12 of the fixed body 10 and formed with a screw bore 54 screwed onto the threaded portion 41 of the fixing rod 40.

Figure 9:
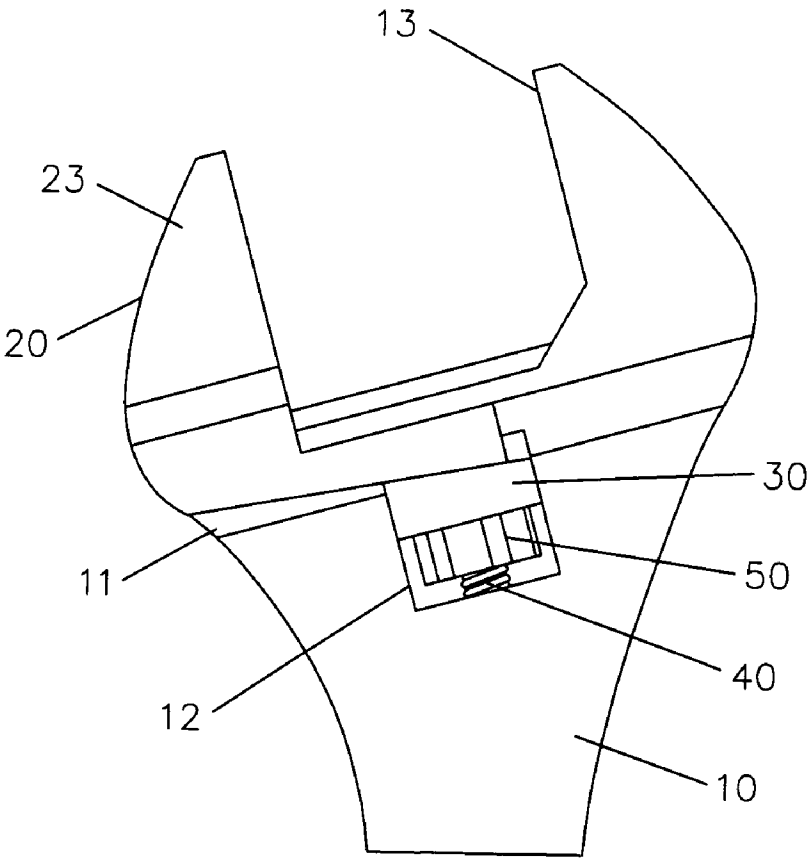
FIG. 9 is a top plan view of the adjustable wrench as shown in FIG. 7.

As shown in FIG. 9, when the urging block 50 is screwed forward, the urging block 50 is moved forward on the fixing rod 40 to press the fixing block 30, so that the first inclined face 31 of the fixing block 30 is rested on the inclined face 22 of the mounting edge 21 of the movable body 20, and the movable body 20 is fixed on the fixed body 10.

Figure 10:
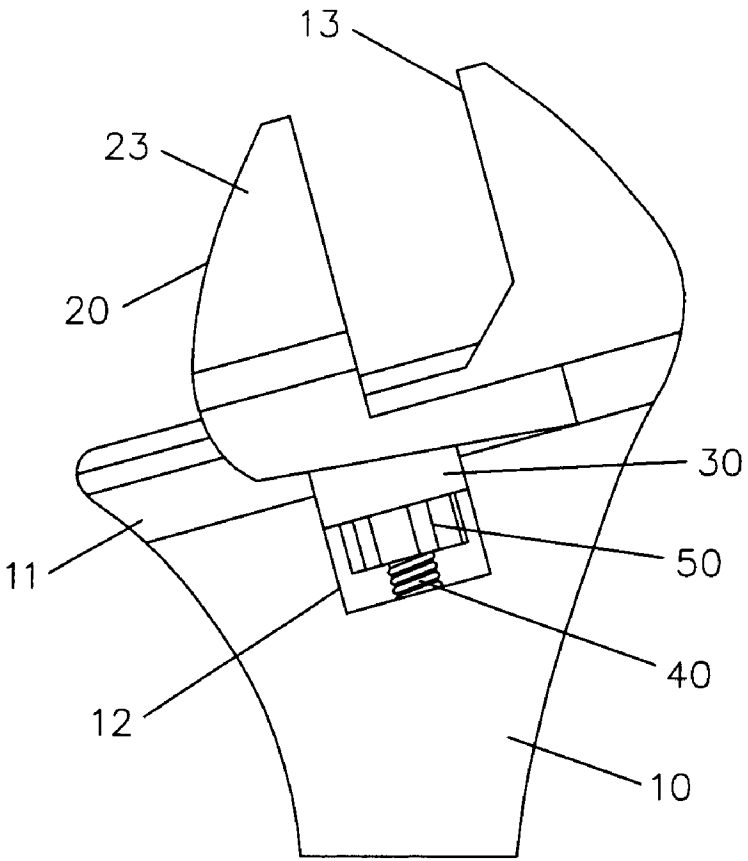
FIG. 10 is a schematic operational view of the adjustable wrench as shown in FIG. 9.

As shown in FIG. 10, the movable body 20 is pushed rightward to detach the inclined face 22 of the mounting edge 21 of the movable body 20 from the first inclined face 31 of the fixing block 30. Then, the urging block 50 is screwed forward and the urging block 50 is moved forward on the fixing rod 40 to press the fixing block 30, so that the first inclined face 31 of the fixing block 30 is again rested on the inclined face 22 of the mounting edge 21 of the movable body 20, and the movable body 20 is fixed on the fixed body 10.

Figure 11:
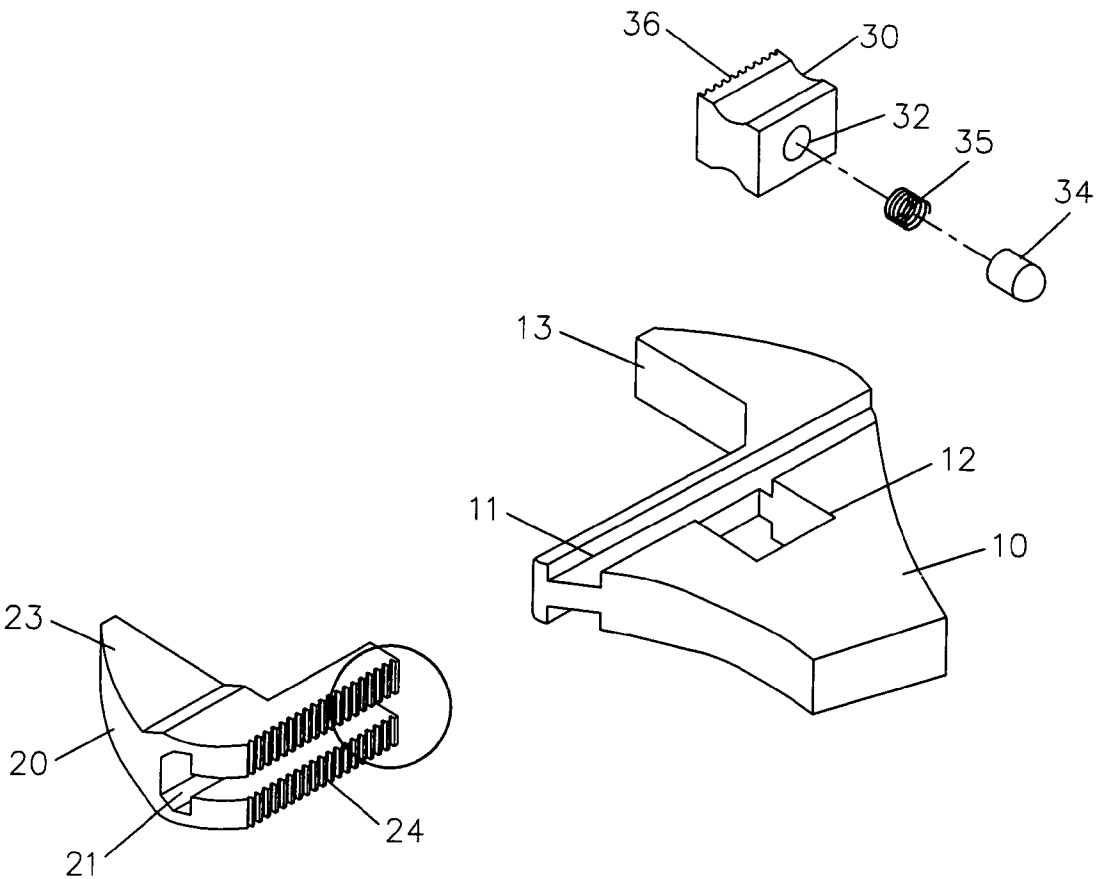
FIG. 11 is an exploded perspective view of an adjustable wrench in accordance with another embodiment of the present invention.
Figure 12:
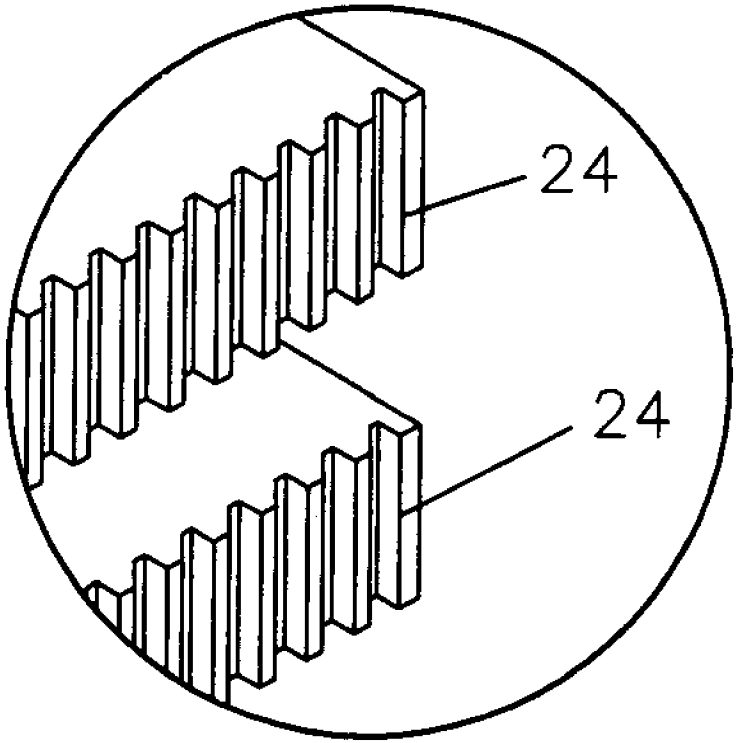
FIG. 12 is a partially enlarged view of the adjustable wrench as shown in FIG. 11.

Referring to FIGS. 11 and 12, the mounting edge 21 of the movable body 20 has a side formed with a plurality of engaging teeth 24, and the fixing block 30 is movably mounted in the receiving recess 12 of the fixed body 10 and has a side formed with a plurality of locking teeth 36 engaged with the engaging teeth 24 of the mounting edge 21 of the movable body 20. A spring 35 is mounted in the circular hole 32 of the fixing block 30, and a push rod 34 is mounted in the circular hole 32 of the fixing block 30 and has a first end urged on the spring 35 and a second end rested on an end face of the receiving recess 12 of the fixed body 10.

Figure 13:
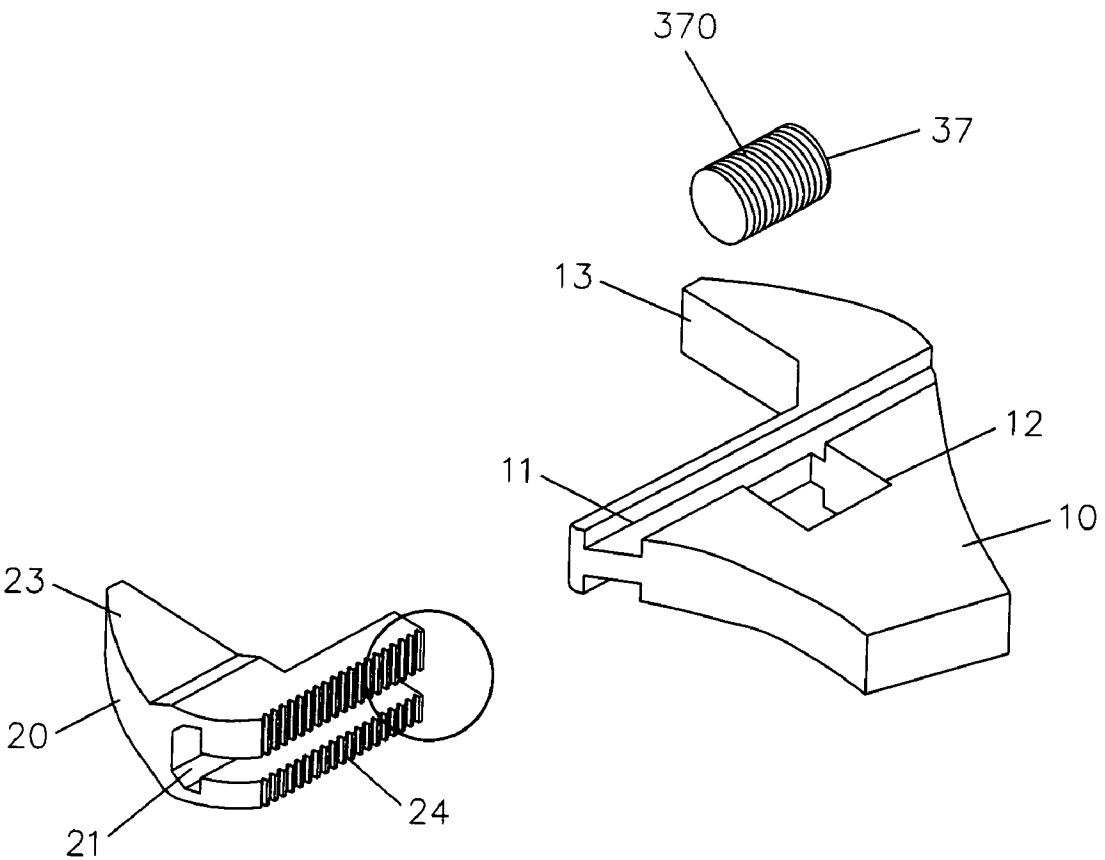
FIG. 13 is an exploded perspective view of an adjustable wrench in accordance with another embodiment of the present invention.
Figure 14:
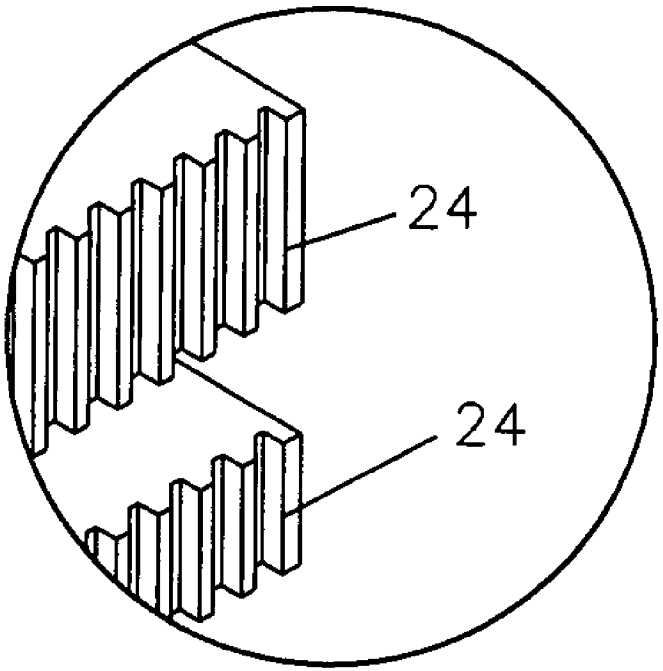
FIG. 14 is a partially enlarged view of the adjustable wrench as shown in FIG. 13.
Figure 15:
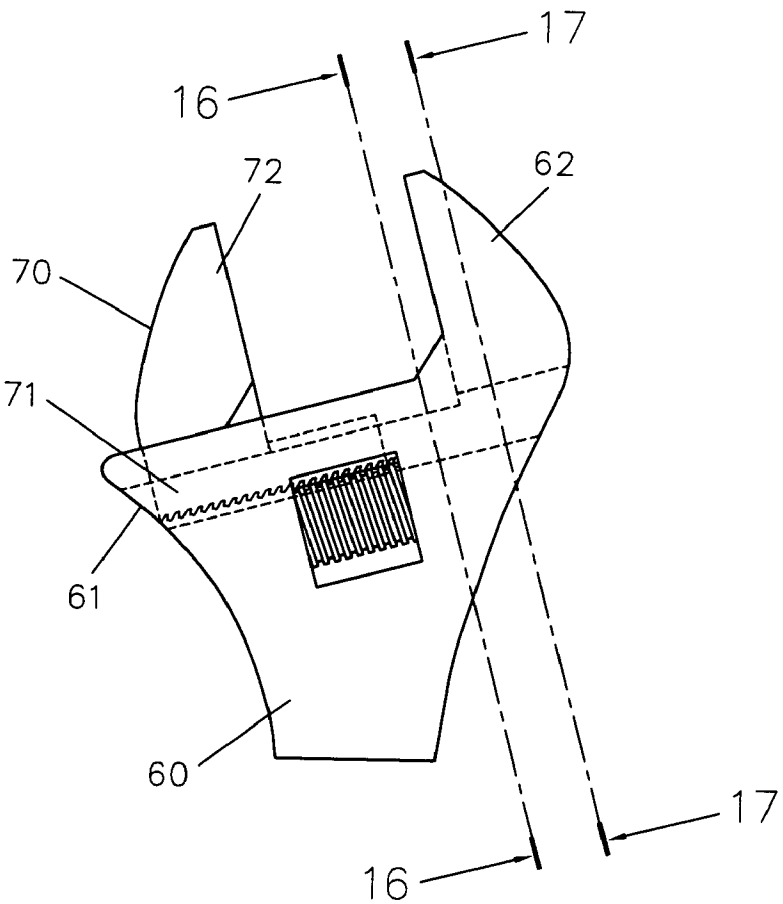
FIG.15 PRIOR ART
FIG. 15 is a top plan view of a conventional adjustable wrench in accordance with the prior art.
Figure 16:
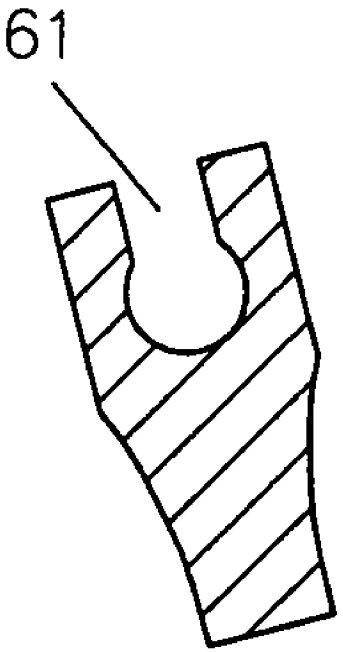
FIG.16 PRIOR ART
FIG. 16 is a plan cross-sectional view of the conventional adjustable wrench taken along line 16—16 as shown in FIG. 15.
Figure 17:
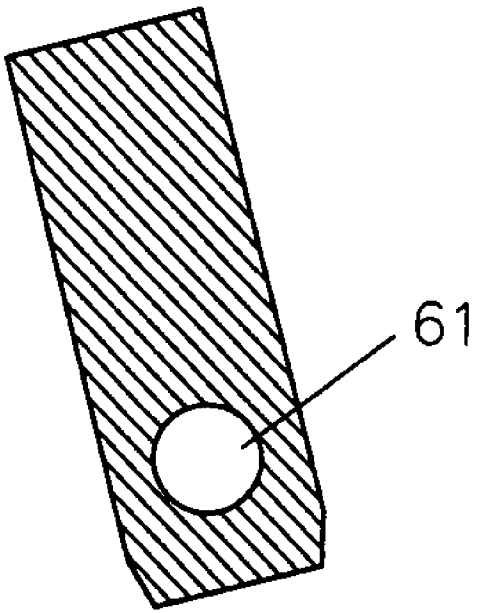
FIG.17 PRIOR ART
FIG. 17 is a plan cross-sectional view of the conventional adjustable wrench taken along line 17—17 as shown in FIG. 15.

Referring to FIGS. 13 and 14, the mounting edge 21 of the movable body 20 has a side formed with a plurality of engaging teeth 24, and a threaded rod 37 is rotatably mounted in the receiving recess 12 of the fixed body 10 and formed with a screw portion 370 engaged with the engaging teeth 24 of the mounting edge 21 of the movable body 20.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An adjustable wrench comprising:

a fixed body having a first end formed with a fixed jaw, a mediate portion formed with a substantially H-shaped mounting portion, a second end formed with a receiving recess communicating with the H-shaped mounting portion and a fixing hole defined in a wall of the receiving recess;

a movable body movably mounted on the fixed body and having a first end formed with a movable jaw facing the fixed jaw of the fixed body and a second end formed with a substantially C-shaped mounting edge slidably mounted on the mounting portion of the fixed body, the C-shaped mounting edge comprising an inclined face formed on a side;

a fixing block being movable in the receiving recess of the fixed body and comprising a first side formed with a first inclined face rested on the inclined face of the C-shaped mounting edge of the movable body, a second side formed with a second inclined face and a hole defined therein;

an urging block being movable in the receiving recess of the fixed body and comprising a first side formed with an oblique press face rested on the second inclined face of the fixing block, a second side rested on an end face of the receiving recess of the fixed body and a slot defined therein; and a fixing rod extended through the fixing hole of the fixed body, the hole of the fixing block and the slot of the urging block to limit the fixing block and the urging block in the receiving recess of the fixed body.

* * * * *